US007171152B2

(12) United States Patent
Akagi et al.

(10) Patent No.: US 7,171,152 B2
(45) Date of Patent: Jan. 30, 2007

(54) IMAGE-FORMING APPARATUS AND IMAGE-FORMING METHOD

(75) Inventors: Hideyuki Akagi, Minamiashigara (JP); Satoshi Shigezaki, Minamiashigara (JP); Katsumi Nukada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 10/870,557

(22) Filed: Jun. 18, 2004

(65) Prior Publication Data

US 2005/0019071 A1 Jan. 27, 2005

(30) Foreign Application Priority Data

Jun. 20, 2003 (JP) ..... 2003-176181

(51) Int. Cl.
*G03G 21/00* (2006.01)

(52) U.S. Cl. ..... 399/356; 399/349; 399/357; 430/125

(58) Field of Classification Search ..... 399/356, 399/353, 354, 349, 357, 343; 430/125
See application file for complete search history.

(56) References Cited

U.S. PATENT DOCUMENTS

| | | | | |
|---|---|---|---|---|
| 3,501,294 | A | 3/1970 | Joseph | 430/125 |
| 3,580,673 | A * | 5/1971 | Yang | 399/356 X |
| 4,436,412 | A * | 3/1984 | Yamagata et al. | 399/356 |
| 4,482,244 | A * | 11/1984 | Yamazaki et al. | 399/356 |
| 4,623,243 | A * | 11/1986 | Iijima et al. | 399/343 X |
| 5,241,327 | A * | 8/1993 | Rubin et al. | 399/356 X |
| 5,289,249 | A * | 2/1994 | Yamamoto et al. | 399/359 |
| 5,875,375 | A * | 2/1999 | Ohmori et al. | 399/159 |
| 6,704,534 | B2 * | 3/2004 | Hibino | 399/277 |
| 2002/0181983 | A1 * | 12/2002 | Shakuto et al. | 399/357 |
| 2003/0137576 | A1 * | 7/2003 | Miho et al. | 347/129 |
| 2003/0219291 | A1 * | 11/2003 | Tokimatsu et al. | 399/359 |
| 2004/0062568 | A1 * | 4/2004 | Nukada et al. | 399/159 |

FOREIGN PATENT DOCUMENTS

| | | | |
|---|---|---|---|
| JP | 51-22380 | | 7/1976 |
| JP | 57-052067 | A * | 3/1982 |
| JP | 58-059481 | A * | 4/1983 |
| JP | 59-136774 | A * | 8/1984 |
| JP | 59-206858 | A * | 11/1984 |
| JP | 05-088592 | A * | 4/1993 |
| JP | 05-289594 | A * | 11/1993 |
| JP | 06-130781 | A * | 5/1994 |
| JP | 2001-034111 | | 2/2001 |

* cited by examiner

*Primary Examiner*—Sophia S. Chen
(74) *Attorney, Agent, or Firm*—Morgan, Lewis & Bockius, LLP

(57) ABSTRACT

An image-forming apparatus with multiple toner image-forming units that form toner images by developing electrostatic latent images by means of a developer containing a nonmagnetic toner and a magnetic carrier. Each of the toner image-forming units has a photoreceptor, a developing device that develops an electrostatic latent image borne on the surface of the photoreceptor, and multiple cleaning rolls, which have a magnetic particle layer of magnetic particles at the surface that are located in the state freely rotatable and in contact with or in the neighborhood of the surface of the photoreceptor. Furthermore, the cleaning rolls absorb nonmagnetic toners present on the surface of the photoreceptor on the magnetic particle layer thereof by rotation and the photoreceptor is rotating at a peripheral velocity of approximately 200 mm/sec or more.

10 Claims, 2 Drawing Sheets

IMAGE-FORMING APPARATUS AND IMAGE-FORMING METHOD

BACKGROUND OF THE INVENTION

1. Field of the Invention

The present invention relates mainly to a high-speed, high-image quality full-color tandem image-forming apparatus and to a full-color tandem image-forming method for use in electrophotographic and electrostatic recording processes.

2. Description of the Related Art

Hitherto, there have been known a variety of image-forming apparatuses employing electrophotographic technology such as copying machines and printers.

Recently, use of full-color copying machines and printers and the like that employ color toners in yellow, magenta, and cyan as well as a black toner has been expanding rapidly.

An intermediate transfer belt is often used in these full-color copying machines and printers for improving the image-forming speed and the quality of images formed.

Full-color image-forming apparatuses employing such an intermediate transfer belt are equipped with multiple toner image-forming units corresponding respectively to four colors: yellow, magenta, cyan and black. Each toner image-forming unit includes a photoreceptor that rotates bearing an electrostatic latent image, and a developing device that develops the electrostatic latent image into a toner image on the surface of the photoreceptor by supplying a toner to the photoreceptor bearing the electrostatic latent images. In these image-forming apparatuses, image signals in four colors, yellow, magenta, cyan and black, are input respectively to the toner image-forming units corresponding to the respective colors, and in each toner image-forming unit, an electrostatic latent image is formed, based on the image signal, on the photoreceptor, which is previously electrostatically charged uniformly, and developed into a toner image. The four toner image-forming units are placed tandem in the circulating direction of the intermediate transfer belt, and the toner images formed in each toner image-forming unit are transferred and superimposed one by one on the circulating intermediate transfer belt (hereinafter, the transfer is referred to as the primary transfer). Subsequently, the superimposed toner image on the intermediate transfer belt is transferred (secondary transfer) and fused on a recording medium, to give the image on the recording medium.

On the photoreceptor after each primary transfer, there remain discharge products generated by electrostatic charge, toner particles not transferred and remaining on the photoreceptor, and the like. Blade cleaning method, wherein a blade, for example, made of a polyurethane rubber is brought into contact with the photoreceptor to scrape off the deposits, has been hither to practiced for removal of these discharge products, the residual toners after transfer, and the like. The blade cleaning method uses the residual toners after transfer, which are supposed to be removed, as the lubricant and abrasive for attaining favorable cleaning characteristics. Accordingly, presence of a smaller amount of residual toners after transfer, which is favorable in itself, causes disadvantages that it leads to decrease in lubricity and hence to the wear and crack of blade, or to decrease in polishing ability resulting in insufficient removal of the discharge products. Further, it also results in fluctuation in the amount of residual toner depending on the images formed in the full-color image-forming apparatuses that uses an intermediate transfer belt. For example, a single image is often formed or printed in great number in these high-speed high-throughput image-forming apparatuses. In such a case, the toner image is often not formed on some of the electrostatic latent image-bearing bodies, depending on the kind of the image (e.g., business card, flier in a particular color or in black and white, or the like), sometimes leading to significant deficiency in the amount of residual toners after transfer. There are image-forming devices which, when the output number reaches a certain value or the ratio of the image density to the cumulative rotation number of the photoreceptor reaches a certain threshold value, suspend forming the image once and then form a toner band on the photoreceptor by supplying the toner to the photoreceptor independent of the image to be formed, and thus prevent the decrease in lubricity and polishing ability.

However, as suspension of image forming leads practically to decrease in image-forming efficiency and the supply of the toner independent of the formed image onto the photoreceptor increases the amount of the toner consumed, such image-forming apparatuses do not allow formation of the toner band sufficient for allowing advantageous effects, but rather lead to wear and crack of the blade therein and deficiency in cleaning ability and thus to defects in the image quality of formed images.

Alternatively, a method of applying a metal soap such as ZnSt or the like as the solid lubricant for the surface of photoreceptor and thus preventing increase in the friction between the surface of the-photoreceptor and the blade was proposed (e.g., see Japanese Patent Application Publication No. 51-22380). In the method, the amount of the metal soap applied onto the photoreceptor is determined in advance in such a manner that the lubricity between the surface of the photoreceptor and the blade is kept at a suitable level.

However, even in such toner image-forming units having the photoreceptor, the surface thereof being coated with the metal soap, increase in the amount of residual toners after transfer leads to increase in the amount of the fatty acid metal salt scraped off, as the residual toners after transfer are used as the abrasive. In image-forming apparatuses wherein multiple toner image-forming units are placed side by side in the circulating direction of an intermediate transfer belt, occurs occasionally a phenomenon called "retransfer" that part of the toner image previously transferred onto the intermediate transfer belt migrate onto the surface of the photoreceptor whereon the next toner image is borne. Electrostatic latent image-bearing bodies placed further downstream in the circulating direction of the intermediate transfer belt absorb a greater amount of toners by the retransfer. The toners adhered by the retransfer also function as the abrasive together with the residual toners after transfer, and accordingly a greater amount of the fatty acid metal salt on the photoreceptor located further downstream is scraped off, resulting in deterioration of the lubricity between the surface of the photoreceptor and the blade. Increase in the amount of fatty acid metal salt applied onto the electrostatic latent image-bearing bodies, which are located further downstream, is suggested (e.g., see Japanese Patent Application Laid-open No. 2001-34111), but adoption of such a method does not allow the image-forming apparatuses to cope with the fluctuation in the amount of residual toners dependent on formed images or to keep the favorable cleaning characteristics for an extended period of time.

SUMMARY OF THE INVENTION

The present invention has been made in view of the above circumstances and provides an image-forming apparatus having a cleaning mechanism that bestow favorable cleaning characteristics for an extended period of time, and an image-forming method including a cleaning step that allows favorable cleaning for an extended period of time.

An image-forming apparatus according to the present invention is an image-forming apparatus including multiple toner image-forming units that form toner images by developing electrostatic latent images by means of a developer containing a nonmagnetic toner and a magnetic carrier, that transfers and superimposes the toner images formed in respective toner image-forming units one by one to give a final superimposed image on the recording medium, fuses the superimposed toner image on the recording medium, and forms the fused toner image on the recording medium, wherein:

Each of the toner image-forming units is equipped with a photoreceptor, a developing device for supplying the developer above to the surface of the photoreceptor and develops an electrostatic latent image borne on the surface of the photoreceptor, and multiple cleaning rolls having a magnetic particle layer of magnetic particles at the surface, which are located in the state freely rotatable and in contact with or in the neighborhood of the surface of the photoreceptor, and absorb nonmagnetic toners present on the surface of the photoreceptor on the magnetic particle layer thereof by rotation;

and the photoreceptor is rotating at a peripheral velocity of 200 mm/sec or more.

According to the image-forming apparatus of the present invention, the lubricity with the surface of the photoreceptor is definitely smaller than that by using a blade, as the deposits on the surface of the photoreceptor are removed by the above cleaning rolls. In addition, because the cleaning roll removes the nonmagnetic toners present on the latent image-bearing surface by the use of magnetic force, the fluctuation in the amount of residual toners depending on the formed image does not affect the cleaning performance at all. Further, presence of multiple cleaning rolls improves the cleaning efficiency drastically. Therefore, the image-forming apparatus according to the present invention is equipped with a cleaning mechanism that bestows favorable cleaning characteristics thereon for an extended period of time.

An image-forming method according to the present invention is an image-forming method that, in a system wherein multiple toner image-forming units for forming toner image by developing the electrostatic latent image on the electrostatic latent image-bearing bodies by using a nonmagnetic toner and a developer containing a magnetic carrier are installed, includes the steps of forming a toner image in each toner image-forming unit; transferring the toner image onto the recording medium; and fusing the transferred toner image on the recording medium; wherein the image-forming method further includes the steps of: developing the electrostatic latent image borne on the surface of the photoreceptor by supplying the developer to the surface of the photoreceptor which is rotating at a peripheral velocity of 200 mm/sec or more; transferring the toner image obtained in the developing step above; and then removing the nonmagnetic toners remaining on the surface of the photoreceptor (cleaning step); and the cleaning is conducted by multiple cleaning rolls having a magnetic particle layer of magnetic particles at the surface, which are located in the state freely rotatable and in contact with or in the neighborhood of the surface of the photoreceptor.

As described above, the present invention provides an image-forming apparatus equipped with a cleaning mechanism that allows favorable cleaning characteristics for an extended period of time, and an image-forming method having a cleaning step that allows favorable cleaning for an extended period of time.

BRIEF DESCRIPTION OF THE DRAWINGS

Preferred embodiments of the present invention will be described in detail based on the following figures, wherein.

DETAILED DESCRIPTION OF THE INVENTION

Hereinafter, embodiments of the present invention will be described.

Figure 1:
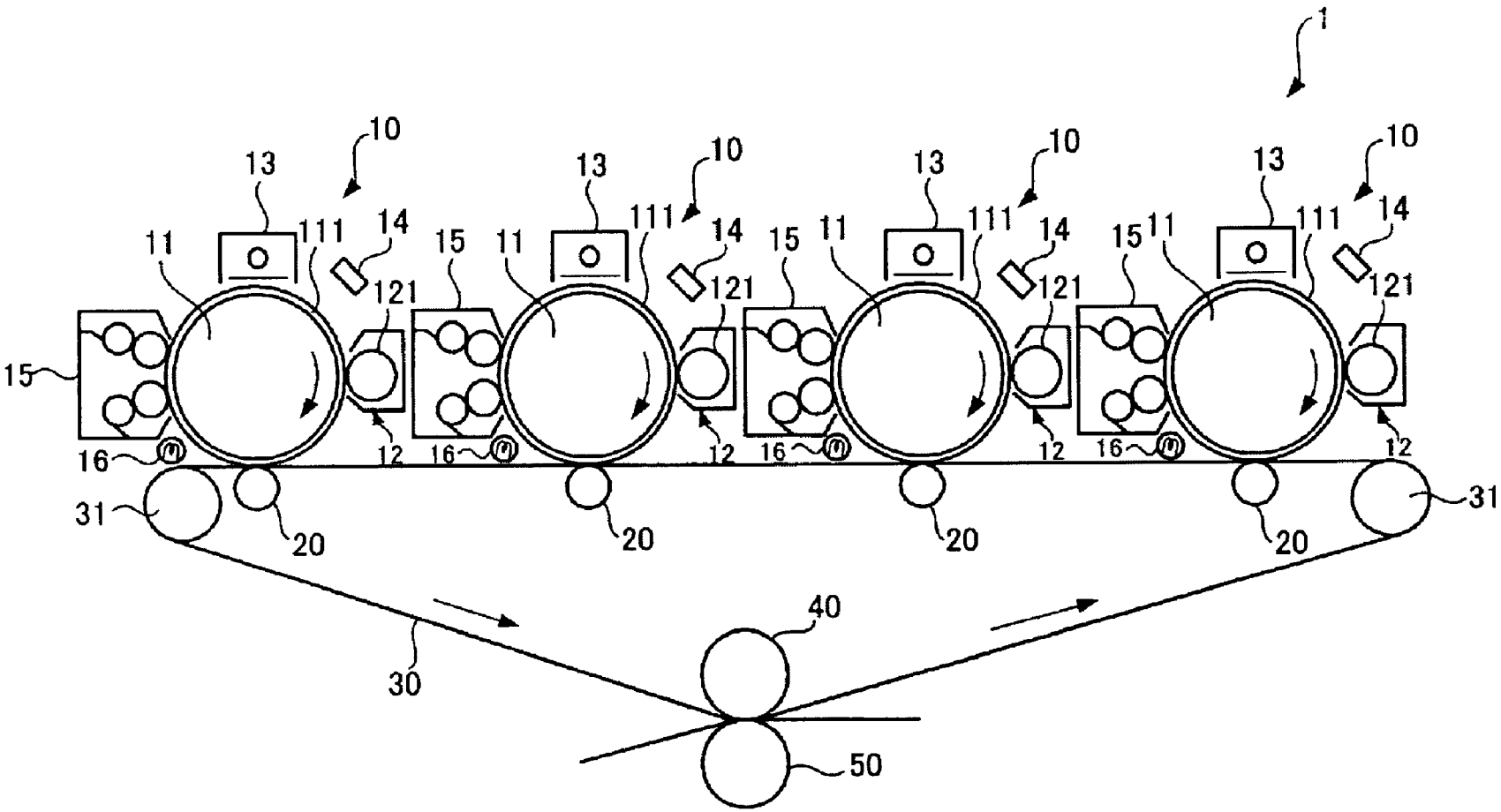
FIG. 1 is a schematic drawing illustrating an embodiment of the image-forming apparatus according to the present invention.

FIG. 1 is a schematic drawing illustrating an embodiment of the image-forming apparatus according to the present invention.

The image-forming apparatus 1 of the embodiment is a an full-color tandem image-forming apparatus, that, by using four toner image-forming units corresponding respectively to four toners in yellow, magenta, cyan and black, forms four toner images different in color respectively by the toner image-forming units in sync with the traveling intermediate transfer belt, superimposes these toner images on the intermediate transfer belt (primary transfer), and then transfers and fixates the composite image to a paper.

The image-forming apparatus 1 set forth in FIG. 1 is equipped with four toner image-forming units 10, four primary transfer rolls 20, an intermediate transfer belt 30 circulating counterclockwise as supported by two supporting rolls 31, a backup roll 40, and a secondary transfer roll 50 placed at a place facing the backup roll 40. A recording medium (paper) not shown in the figure is fed into the slit between the backup roll 40 and the secondary transfer roll 50 facing each other. The toner images formed in respective toner image-forming units 10 are superimposed on the intermediate transfer belt 30, and transferred together onto the fed paper. Subsequently, the image on the paper is melt-fixed in a fixing unit not shown in the figure.

Each toner image-forming unit 10 has a photoreceptor 11 rotating clockwise. The photoreceptor 11 has a high peripheral velocity of 200 mm/sec or more. In addition, the photoreceptor 11 has, on the external surface of a drum-shaped conductive support, a laminate composed of an undercoat layer, an electric charge generation layer, and a charge transport layer in that order from the conductive support upward, and the photoreceptor 11 has a surface layer 111 containing a fluorine resin on the surface of the laminate. The surface layer 111 is the outermost layer of the photoreceptor 11, and may be made of a single fluorine resin or two or more fluorine resins. The surface layer 111 contains at least partially a fluorine resin, and thus may contain other resin(s) in addition to the fluorine resin.

The method for forming the surface layer 111 is not particularly limited, but the layer may be formed by the impregnation treatment described below.

The impregnation treatment is conducted by using a treatment solution having a certain composition and applying the treatment solution onto the laminate surface, for example, by means of impregnation or coating.

The treatment solution may be a dispersion of a fluorine resin containing a homopolymer and/or a copolymer of tetrafluoroethylene (hereinafter, referred to as the particular fluorine resin), and in particular of a mixture of a homopolymer and a copolymer of tetrafluoroethylene at a suitable ratio of (homopolymer):(copolymer), for example, possibly in the range of 95:5 to 10:90 and probably in the range of 90:10 to 20:80.

Another fluorine resin may be also used together with the particular fluorine resin above as the fluorine resin in the treatment solution. Examples of the other usable fluorine resins include homopolymers and/or copolymers of vinylidene fluoride, homopolymers and/or copolymers of chlorotrifluoroethylene, and the like. The amount of the other fluorine resin blended is probably in the range of 5 to 100 parts, with respect to 100 parts of the particular fluorine resin.

Examples of the comonomers for the copolymers of the particular fluorine resin and other fluorine resin usable together therewith include olefins, fluorine-containing olefins, perfluoroolefins, fluoroalkylvinylethers, and the like. The copolymerization ratio of these comonomers may be in the range of 0.01 to 1 mole% and probably in the range of 0.02 to 0.9 mole % with respect to 1 mole of all recurring units in the copolymer.

If a resin other than the fluorine resins is contained in the layer containing a fluorine resin, the resin may be a polyolefin resin, silicone resin, polyester resin, or the like. The content of the other resins, if contained, is probably in the range of 1 to 100 parts with respect to 100 parts of the fluorine resin.

The treatment solution containing the particular fluorine resin above as the preferred component is used for application onto the laminate surface in the form of an aqueous dispersion containing water as the main dispersing medium.

For preparation of the aqueous dispersion, i.e., the treatment solution, the particular fluorine resin and other resins may be dispersed homogeneously by using an anionic, nonionic, cationic or ampholytic surfactant. It is also possible to use a suitable amount of an organic solvent additionally in the aqueous dispersion. Selection of the optimal surfactant and solvent allows preparation of an aqueous dispersion containing the fluorine resins uniformly and stably dispersed and smoother dispersion and penetration of the fluorine resin-containing resin into the laminate surface.

The treatment solution having the particular fluorine resin as the preferred component may additionally contain as needed a wax, brightener, stabilizer, ultraviolet absorbent, pH adjuster, polyvalent alcohol, plasticizer, viscosity adjuster, or the like.

The concentration of solid matters in the treatment solution may be in the range of about 10 to 70 weight %, and the concentration of the fluorine resin in the treatment solution is possibly in the range of 0.1 to 30 weight %, but these concentrations are not particularly limited to the ranges above.

The surface layer 111 may be formed by a coating impregnation treatment, heated impregnation treatment, vacuum impregnation treatment, or pressurized impregnation treatment, as will be described below.

By the coating impregnation treatment, a surface layer is formed by applying the treatment solution onto the laminate surface and allowing the resulting coated layer to stand for a certain period. During the treatment, the amount of the treatment solution coated on the laminate surface is appropriately adjusted so that the thickness of the treatment solution falls in the range of 5 to 20 μm. Thus, the concentration of solid matters in the treatment solution is possibly adjusted in the range of 5 to 50 weight %. Subsequently, the treatment solution coated on the laminate surface is allowed to stand for penetration into the laminate for a certain period and then dried for forming the surface layer 111.

Therefore, when the thickness of the treatment solution is less than 5 μm, the formed surface layer 111 may have some portions extremely thinner, leading to uneven exfoliation of toner due to uneven contact between the surface layer and the intermediate transfer belt, i.e., drastic decrease in local transfer efficiency in some portions due to the uneven exfoliation of toner and thus image defects at the portions. On the other hand, when the coating thickness of the treatment solution is more than 20 μm, the treatment solution may become more flowable and the thickness of the surface layer formed irregular, consequently leading to image defects.

The certain period for standing the coated layer may be 15 minutes or more and probably 30 minutes or more. If the period is less than 15 minutes, the amount of fluorine resin embedded in the laminate decreases, and sometimes production of the surface layer having a sufficiently high strength is prohibited due to shortage of the drying period.

By the heated impregnation treatment above, a treatment solution is applied on the laminate surface and dried at a temperature higher than normal temperature.

By the vacuum impregnation treatment, a treatment solution is applied onto the laminate surface and dried at normal temperature or higher, repeatedly under reduced and atmospheric pressures.

Further, by the pressurized impregnation treatment, a treatment solution is applied on the laminate surface and dried at normal temperature or higher, repeatedly under elevated and atmospheric pressures.

Methods for applying the treatment solution onto a laminate surface by the heated impregnation treatment, vacuum impregnation treatment, and pressurized impregnation treatment include those of immersing the laminate into the treatment solution; placing the laminate in a container and then pouring the treatment solution therein; blade coating, wire bar coating, spray coating, dip coating, bead coating, air knife coating, and curtain coating of the treatment solution; and the like.

In the heated, vacuum, and pressurized impregnation treatments, the temperature of "normal temperature or more" described above may be in the range of 10 to 100° C. and probably in the range of 40 to 80° C. If the temperature is higher than 100° C., heating may result in deformation of the surface layer due to thermal expansion or shrinkage. On the contrary, treatment at a temperature of less than 10° C. requires an elongated period of time for drying and may result in decrease in productivity.

The vacuum used in the vacuum impregnation treatment may be 0.01 MPa or more and 0.09 MPa or less, and more likely in the range of 0.015 to 0.09 MPa.

The pressure used in the pressurized impregnation treatment may be in the range of 0.1 to 1 MPa and more likely If the vacuum used in the vacuum impregnation treatment is lower than 0.01 MPa, more low-boiling point solvents in the treatment solution evaporate, shortening the lifetime of the treatment solution. If the vacuum is higher than 0.09 MPa, it becomes more difficult to remove the residual gas in the coated layer, sometimes leading to poorer penetration of the fluorine resins.

In an analogous manner, the pressure used in the pressurized impregnation treatment is possibly higher than 0.1 MPa for facilitating penetration of the fluorine resins sufficiently into the fine voids of the laminate. A pressure of over 1 MPa would demand the treatment facility to have greater pressure resistance, leading to increase in production cost.

The processing conditions, including the concentration of the fluorine resin-containing resin in the treatment solution, the content of solid matters in the treatment solution (viscosity adjustment), the temperature, vacuum, and pressure of the treatment solution, the number of repeating vacuum and atmospheric pressures and of repeating elevated and atmospheric pressures, and the like, may be adjusted freely according to the desirable photoreceptor.

In the manner above, a desirable surface layer 111 may be formed by applying the treatment solution on the laminate surface by one of the impregnation treatments above, removing the excessive treatment solution, and drying the coated film at 40 to 80° C., particularly probably at 50 to 70° C. for about 5 to 30 minutes, and further the dents on the laminate surface if present may be filled with the resin.

The formed surface layer 111 may have a coefficient of dynamic friction of the surface possibly at 0.5 or less, probably at 0.3 or less, from the viewpoint of surface smoothness.

Alternatively, the surface layer containing a fluorine resin 111 may be replaced with a surface layer containing a silicone resin.

A resin containing a silicone resin having a crosslinked structure and an electric charge transport property may be particularly as the surface layer, from the viewpoints of transparency, dielectric breakdown resistance, light stability, and the like. The crosslinked resins having siloxane bonds are generally resins wherein dimethylsilicone, methylphenylsilicone, and other desirable components are crosslinked three dimensionally. In particular, siloxane bond-containing crosslinked resins containing a compound that has an organic group F derived from an optically functional compound, a flexible organic subunit D, and a substituted silicon group A having a hydrolyzable group are probable in the present invention, from the viewpoints of the characteristics above and further of wear resistance, electric charge transport, and the like. In such a case, the compound is only required to contain an organic group F derived from an optically functional compound, a flexible organic subunit D, and a substituted silicon group having a hydrolyzable group A, and these groups are not necessarily bound to the compound in that order.

$$F\text{-}[D\text{-}A]_b \qquad \text{Formula (I)}$$

In Formula (I), F represents an organic group derived from an optically functional compound; D represents a flexible organic subunit; A represents a substituted silicon group having a hydrolyzable group having a formula of $—Si(R_1)_{(3-a)}Q_a$ (wherein, $R_1$ represents hydrogen, an alkyl group, or a substituted or unsubstituted aryl group; Q represents a hydrolyzable group; and a is an integer of 1 to 3); and b is an integer of 1 to 4.

The group F in Formula (I) is possibly a group having a positive hole-transporting capability or an electron-transporting capability. In particular, specific examples of the groups having an electron-transporting capability include organic groups derived from quinone compounds, fluorenone compounds, xanthone compounds, benzophenone compounds, cyanovinyl compounds, ethylene-based compounds, and the like. Specific examples of the group having a positive hole-transporting capability include compounds having a photocarrier transport characteristic such as triarylamine compounds, benzidine compounds, arylalkane compounds, aryl-substituted ethylene-based compounds, stilbene compounds, anthracene compounds, hydrazone compounds, quinone compounds, fluorenone compounds, xanthone compounds, benzophenone compounds, cyanovinyl compounds, and ethylene-based compounds.

The group A in Formula (I) indicates a substituted silicon group having a hydrolyzable group represented by the formula, $—Si(R_1)_{(3-a)}Q_a$, which leads to generation of three dimensional Si—O—Si bond network, i.e., an inorganic glass network by cross-linking each other due to the Si group present therein. The group D in Formula (I) plays a role of connecting the group F for providing photoelectric characteristics directly to the three dimensional inorganic glass network. It also has a function to improve the strength of film by adding a suitable flexibility to the rigid but also brittle inorganic glass network. Specific examples thereof include bivalent hydrocarbon groups represented by $—C_nH_{2n}—$, $—C_nH_{(2n-2)}—$, and $—C_nH_{(2n-4)}—$ wherein n is an integer of 1 to 15; —COO—, —S—, —O—, $—CH_2—C_6H_4—$, —N═CH—, $—(C_6H_4)—(C_6H_4)—$, the combinations thereof, and the substituted derivatives thereof.

Among the compounds represented by Formula (I), compounds having the group F represented by Formula (II) exhibit particularly excellent electron hole-transporting and mechanical characteristics. $Ar_1$ to $Ar_4$ in Formula (II) each represent independently a substituted or unsubstituted aryl group, and more specifically, probably have one of the following Structures 1.

Formula (II)

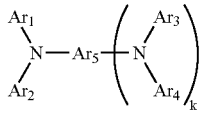

In Formula (II), $Ar_1$ to $Ar_4$ each independently represent a substituted or unsubstituted aryl group, and $Ar_5$ represents a substituted or unsubstituted aryl group or arylene group. However, one to four groups of $Ar_1$ to $Ar_5$ have binding sites connectable to the binding group represented by -D-A in Formula (I). k is 0 or 1.

Structures 1

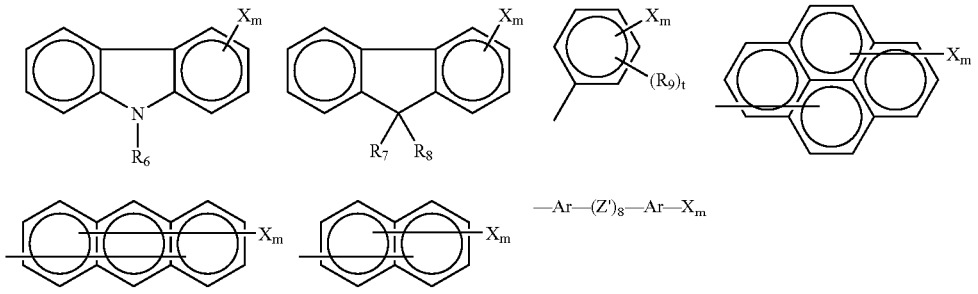

In the Structures above, Ar is possibly a group represented by one of the Structures 2.

Structures 2

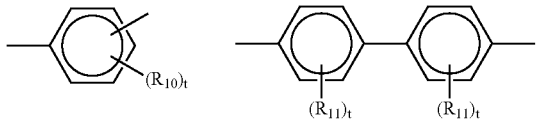

Further, the group Z' above may be a group represented one of the following Structures 3.

When forming the surface layer, it is possible to add at least one compound having a group connectable to the compound represented by Formula (I) for the purpose of further increasing the mechanical strength of the cured film.

The groups connectable to the compound represented by Formula (I) means groups connectable to the silanol group generated by hydrolysis of the compound represented by Formula (I), and more specifically, groups represented by the formula, $—Si(R_1)_{(3-a)}Q_a$, epoxy groups, isocyanate groups, carboxyl groups, hydroxy groups, halogens and the like. Among them, compounds having a hydrolyzable group represented by $—Si(R_1)_{(3-a)}Q_a$, an epoxy group, or an isocyanate group is possible, as they provide higher mechanical strength.

Structures 3

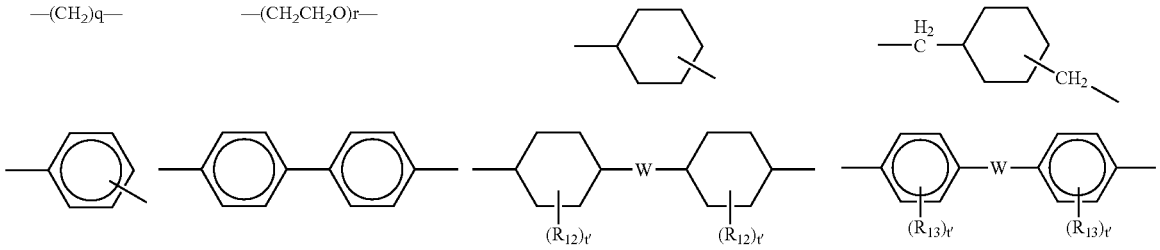

Here, $R_6$ represents hydrogen, an alkyl group having 1 to 4 carbons, a phenyl group substituted with an alkyl group having 1 to 4 carbons or an alkoxy group having 1 to 4 carbons, an unsubstituted phenyl group, or an aralkyl group having 7 to 10 carbons. $R_7$ to $R_{13}$ each represent hydrogen, an alkyl group having 1 to 4 carbons, an alkoxyl group having 1 to 4 carbons, a phenyl group substituted with an alkoxyl group having 1 to 4 carbons, an unsubstituted phenyl group, an aralkyl group having 7 to 10 carbons, or a halogen. m and s each are independently 0 or 1; q and r each are independently an integer of 1 to 10; and t and t' each are independently an integer of 1 to 3. Here, X is the same group as that represented by -D-A in Formula (I) above.

In addition, the group W may be one of the groups represented by the following Structures 4.

Compounds having two or more of these groups in the molecule are possible as the compound having a group connectable to the compound represented by Formula (I), as they provide the resulting cured films with a more three dimensionally crosslinked structure and accordingly a higher mechanical strength. Among them, the most probable compounds include compounds represented by Formula (III).

$$B\text{-}[A']_n \qquad \text{Formula (III)}$$

The group A' in Formula (III) represents a substituted silicon group having a hydrolyzable group represented by the formula $—Si(R_1)_{(3-a)}Q_a$, and the group B, at least one group selected from n-valent hydrocarbon groups which may be branched, n-valent phenyl groups, —NH—, and Structures 4

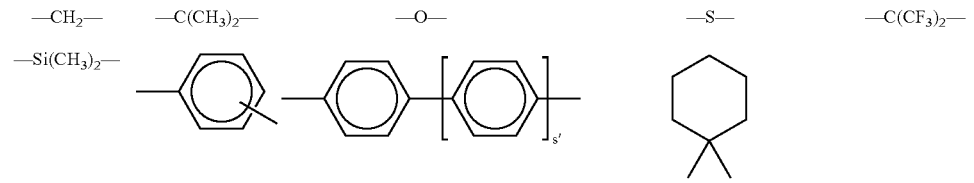

Here, s' is an integer of 0 to 3.

Typical structure of $Ar_5$ in Formula (II) include the structures of $Ar_1$ to $Ar_4$ wherein m is 1, when k is 0; and the structures of $Ar_1$ to $Ar_4$ wherein m is 0, when k is 1.

The optically functional organic silicon compounds represented by Formula (I) may be used alone or in combination of two or more.

—O—Si— or the combinations thereof. a represents an integer of 1 to 3; and n an integer of 2 or more.

The compounds represented by Formula (III) are compounds having two or more substituted-silicon groups A' having a hydrolyzable group represented by the formula $—Si(R_1)_{(3-a)}Q_a$, The Si groups contained in A' react with the compound represented by Formula (I) or the compound (III)

itself, forming Si—O—Si bonds and thus three dimensional crosslinked cured film. Although the compound represented by Formula (I) has similar Si groups, capable of forming a cured film, the compound (III) having two more A' groups seems to form a cured film having a more densely and three dimensionally crosslinked structure, leading to an higher mechanical strength of the resulting film. In addition, it also plays a role of providing the crosslinked cured film with suitable flexiblity, just like the D portion of the compound represented by Formula (I).

The compound (III) is probably one of the compounds represented the following Structures 5.

Structures 5

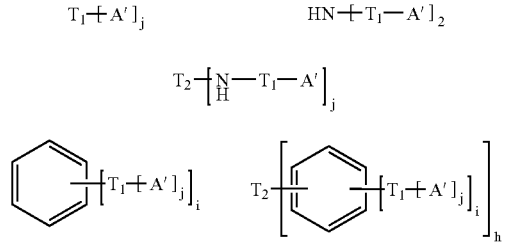

In the formula above, $T_1$ and $T_2$ each independently represent a bivalent or trivalent hydrocarbon group which may be branched; and A' the substituent described above. h, i, and j each are an integer of 1 to 3, and selected so that the number of A's in the molecule becomes 2 or more.

Typical examples of the compounds represented by Formula (III) and also by the formulae above will be described below, but the compounds are not limited thereto.

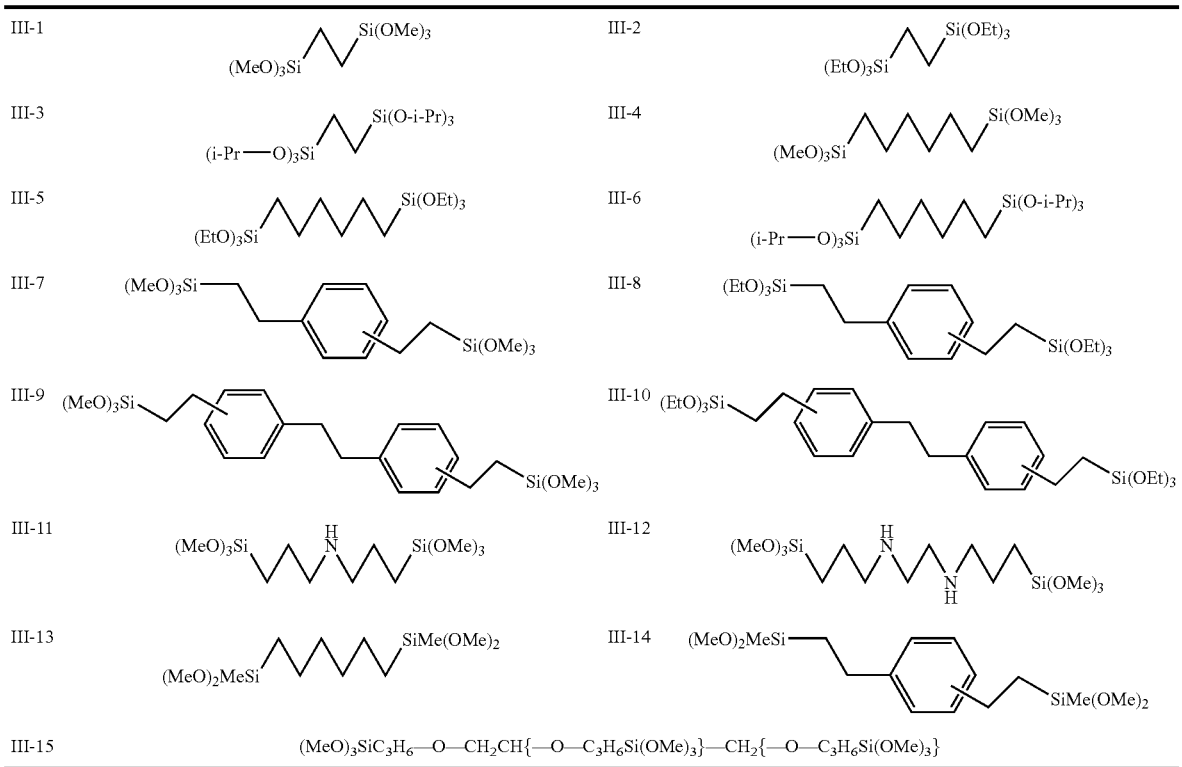

The optically functional organic silicon compounds represented by Formula (I) may be used alone or in combination of two or more. It may be also used together with other compound such as a coupling agent, fluorine compound, or the like, for the purpose of adjusting the coatability and flexiblity of film. Such compounds include various silane coupling agents and commercially available silicone hard-coat agents.

For preparing a crosslinked film as the surface protection layer, addition of an organic metal compound or a curable matrix is possible.

These coating solutions may be prepared in the absence of solvent or in the presence as needed of a solvent such as an alcohol such as methanol, ethanol, propanol, or butanol; a ketone such as acetone, or methylethylketone; an ether such as tetrahydrofuran, diethylether, or dioxane; or the like, and possibly in the presence of a solvent having a boiling point of not higher than 100° C. These solvents may be used as a mixture at an arbitrary ratio. The amount of solvent used may be decided arbitrarily, but is possibly 0.5 to 30 parts, probably 1 to 20 parts with respect to 1 part of the compound represented by Formula (I), as the compound represented by Formula (I) tends to precipitate, if the amount is too low.

The compound represented by Formula (I) and other compounds as needed are reacted by contact with a solid catalyst for preparation of the coating solution. The temperature and the time of the reaction vary according to the kinds of raw materials used, but the temperature is usually 0 to 100° C., probably 0 to 70° C., and more probably, 10 to 35° C. The reaction time is not particularly limited, but probably in the range of 10 minute to 100 hours, because an elongated reaction time may lead to higher possibility of gelation.

If a polymer having a group connectable to the compound represented by Formula (I) is added, presence of both the solid catalyst and the polymer accelerates gelation drastically, making it difficult to prepare a coating solution, and thus the polymer may be added after removal of the solid catalyst. The solid catalyst is not particularly limited, if the catalyst component is insoluble in the solution of the compound represented by Formula (I), the other compounds, the solvent, or the like.

The amount of water added for hydrolytic condensation is not particularly limited, but possibly in the range of 30 to 500%, probably of 50 to 300% with respect to the theoretical amount required for hydrolysis of all hydrolyzable groups in the compound represented by Formula (I), as water affects the storage stability of the product and further the suppression of gelation during polymerization. If the amount of water is greater than 500%, the product has decreased storage stability and tends to precipitate. On the contrary, presence of water in an amount of less than 30% increases the amount of unreacted groups, often leading to phase separation of the polymer during application or curing of the coating solution and also decrease in the strength of the coated film.

In addition, in advance to curing, a protonic acid such as hydrochloric acid, acetic acid, phosphoric acid, sulfuric acid, or the like is added as the curing catalyst. The curing temperature may be selected arbitrarily, but is probably 60° C. or more, more likely 80° C. or more for obtaining the coated layer having a desired strength. The curing time may be set freely as needed, but is possibly 10 minutes to 5 hours. It is also effective to keep the coated layer after the curing reaction under a high humidity condition for stabilization of the characteristics. In addition, the coated layer may be made more hydrophobic by subjected to a surface treatment with hexamethyldisilazane, trimethylchlorosilane, or the like, depending on the application.

The coating methods include methods commonly practiced in the art, such as blade coating, wire bar coating, spray coating, dip coating, bead coating, air knife coating, curtain coating, and the like.

It is also possible to add an antioxidant for the purpose of preventing degradation triggered by the oxidative gases such as ozone generated in the electrostatic charging devices. Increase in the mechanical strength of the surface of photoreceptor 11 and in the lifetime of the photoreceptor 11 is accompanied with an elongated period of exposure of the photoreceptor 11 to the oxidative gases, which demands a higher oxidation resistance than ever from the photoreceptor.

The antioxidant may be a hindered phenol or hindered amine compound, but a publicly known antioxidant such as an organic sulfur antioxidant, phosphite antioxidant, dithiocarbamic acid salt antioxidant, thiourea antioxidant, benzimidazole antioxidant, or the like may also be used. The amount of the antioxidant added is possibly 15 wt % or less, more likely 10 wt % or less with respect to the total weight of the surface layer.

Examples of the hindered phenol antioxidants include 2,6-di-t-butyl-4-methylphenol, 2,5-di-t-butylhydroquinone, N,N'-hexamethylene bis(3,5-di-t-butyl-4-hydroxyhydrocinnamide), 3,5-di-t-butyl-4-hydroxy-benzyl phosphonate diethyl ester, 2,4-bis[(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidenebis(3-methyl-6-t-butyl phenol), 2,5-di-t-amylhydroquinone, 2-t-butyl-6-(3-butyl-2-hydroxy-5-methyl benzyl)-4-methylphenyl acrylate, 4,4'-butylidene bis(3-methyl-6-t-butylphenol), and the like.

Silicone resins, which have electric charge-transporting characteristics and a crosslinked structure, have an excellent mechanical strength as well as sufficiently high photoelectric characteristics and thus may be used per se as the charge transport layer.

The coating methods include methods commonly practiced in the art, including blade coating, wire bar coating, spray coating, dip coating, bead coating, air knife coating, curtain coating, and the like. If a suitable film thickness cannot be obtained by coating only once, the coating may be performed several times for obtaining the desired thickness. If coated several times, the coated films may be heated every time after coating or collectively after coating several times.

The degree of crosslinking of the surface layer may be judged by the hardness of the surface layer, which can be determined by the hardness of the photosensitive body. The hardness of the photosensitive body is possibly in the range of 15 to 35 $mN/\mu m^2$ as dynamic hardness. The dynamic hardness may be determined by using the Shimadzu dynamic hardness tester DUH-201.

Four toner image-forming units 10 are arranged serially in the traveling direction of the intermediate transfer belt 30, and the surface of each photoreceptor 11 thereof is in contact with the intermediate transfer belt 30. Primary transfer rolls 20 are placed at sites facing the respective photoreceptors 11 on the opposite side of the intermediate transfer belt 30, and the sites where respective photoreceptors 11 become in contact with the intermediate transfer belt 30 are primary transfer positions, corresponding to the transfer position according to the present invention.

Each toner image-forming unit 10 is equipped with a developing device 12, an electrostatic charging device 13, an optical writing unit 14, a cleaning unit 15, and an antistatic lamp 16. The developing device 12 is placed at a site upstream of the primary transfer position on the periphery of the photoreceptor 11, and the site where this developing device 12 is located correspond to the developing position according to the present invention. The electrostatic charging device 13 is placed at a site further more upstream of the developing device 12. The optical writing unit 14 is placed at a site between the developing device 12 and the electrostatic charging device 13. Further, the cleaning unit 15 is placed at a site downstream of the primary transfer position on the periphery of the photosensitive drum 11, and the antistatic lamp 16 between the cleaning unit 15 and the primary transfer position.

The surface of the photoreceptor 11 is electrostatically charged uniformly by the electrostatic charging device 13. The optical writing unit 14 has a built-in semiconductor laser and a polygon miller not shown in the Figure. The optical writing unit 14 forms an electrostatic latent image on the surface of photoreceptor 11, which is previously charged uniformly by the electrostatic charging device 13, by irradiating laser beam thereon. The developing device 12 employs two-component developing method, and contains a magnetic carrier and a single-colored negatively charged nonmagnetic toner inside.

The nonmagnetic toner used in this embodiment may be obtained by using a publicly known material and preparing by any one of the processes known in the art. Examples of the production processes include blending and pulverizing process of blending and pulverizing a binder resin and a coloring agent, together with a charge-controlling agent, releasing agent, and the like if needed, and classifying the resulting mixture; emulsion-polymerization flocculation process of emulsion-polymerizing a binder resin and a polymerizable monomer, mixing the formed dispersion with coloring and releasing agents, together with a charge-controlling agent or the like if needed, and coagulating and thermally fusing the resulting mixture to give a toner particle; suspension polymerization process of dispersing a polymerizable monomer for obtaining a binder resin, a coloring agent, and a releasing agent, together with a solution of a charge-controlling agent or the like if needed in an aqueous solvent and polymerizing the resulting mixture; solubilization dispersion method of dispersing a solution of a binder resin, coloring agent, and releasing agent, together with a charge-controlling agent or the like in an aqueous solvent and granulating the resulting mixture; and the like.

The binder resins used include homopolymers and copolymers of: styrenes such as styrene and chlorostyrene; monoolefins such as ethylene, propylene, butylene, and isoprene; vinylesters such as vinyl acetate, vinyl propionate, vinyl benzoate, vinyl butyrate; a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinylethers such as vinylmethylether, vinylethylether, and vinylbutylether; vinylketones such as vinylmethylketone, vinylhexylketone, and vinylisopropenylketone; and the like. Particularly representative examples of the binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and the like. Polyester, polyurethane, epoxy resins, silicone resins, polyamide, modified rosins, paraffin waxes, and the like are also included therein.

Representative examples of the coloring agents for toners include magnetic powders such as magnetite and ferrite, carbon black, aniline blue, Calco Oil blue, chromium yellow, ultramarine blue, du Pont Oil Red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3 and the like.

Typical examples of the releasing agents include low-molecular weight polyethylene, low-molecular weight polypropylene, Fischer-Tropsch wax, montan wax, carnauba wax, rice wax, microcrystalline wax, candelilla wax, and the like.

The toner particle thus obtained may be used together with any one of publicly known powder fluidizing agents, cleaning aids, transfer aids, fine particles such as abrasives, and the like.

The developing device 12 set forth in FIG. 1 has a magnetic roll 121 inside. A developing layer having magnetic carriers sticking out like brush bristles (so-called magnetic brush) whereto toners are attached is formed on the external surface of the magnetic roll 121, and the nonmagnetic toners move from the developing layer to the surface of the photosensitive drum 11 whereon an electrostatic latent image is engraved. Receiving the nonmagnetic toners, the electrostatic latent image is developed into a toner image. The antistatic lamp 16 levels the electric potential on the surface of the photoreceptor 11 after primary transfer, and prevents the magnetic particles, a constituent of the magnetic brush, from adhering to the surface of the photoreceptor 11.

Figure 2:
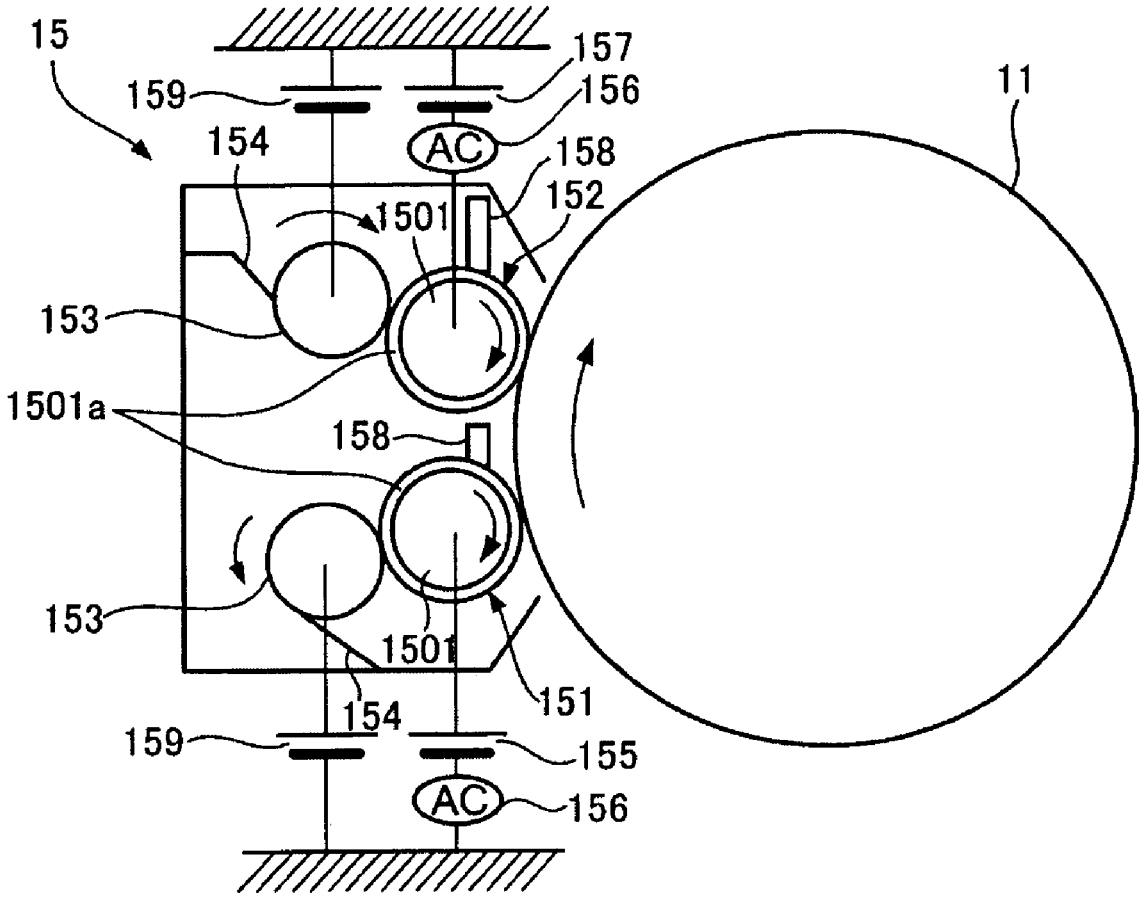
FIG. 2 is a schematic drawing illustrating the structure of the cleaning unit set forth in FIG. 1.

FIG. 2 is a schematic drawing illustrating the structure of the cleaning unit set forth in FIG. 1.

FIG. 2 also shows the photosensitive drum 11 rotating clockwise. The cleaning unit 15 set forth in FIG. 2 has two cleaning rolls 151 and 152, two recovery rolls 153, and two scrapers 154. Two cleaning rolls 151 and 152 are placed side by side in the rotative direction of the photoreceptor 11, and hereinafter the cleaning roll placed upstream in the rotative direction of the photoreceptor 11 is referred to as the first cleaning roll 151 as needed, while the cleaning roll placed downstream in the rotative direction as the second cleaning roll 152. These cleaning rolls 151 and 152 have respectively stationary magnets inside and sleeve rolls 1501 which are rotating oppositely to the rotative direction of the photoreceptor 11. On the external surface of each sleeve roll 1501, there is a magnetic particle layer 1501*a* whereon multiple clusters of conductive magnetic particles aligned linearly are sticking outward like brush bristles (referred to as the magnetic brush). The magnetic particle layer 1501*a* is in contact with the surface of the photoreceptor 11. The cleaning roll may have other magnetic particle layers replacing the magnetic brush, and in some of such cleaning unit equipped with cleaning rolls having the other magnetic particle layer, the cleaning roll is not necessarily brought into contact with the surface of the photoreceptor 11 but located closely thereto. In addition, a direct-current power source 155 and an alternate-current power source 156 for applying a positive direct-current bias, opposite to the electrostatic charge polarity of the nonmagnetic toners stored in the developing device 12 set forth in FIG. 1, are connected to the first cleaning roll 151, and thus the nonmagnetic negatively charged substances are magnetically and electrically attracted to the magnetic particles forming the magnetic particle layer 1501*a* of the first cleaning roll 151. On the other hand, a direct-current power source 157 and an alternate-current power source 156 for applying a negative direct-current bias are connected to the second cleaning roll 152, and thus nonmagnetic positively charged substances are attracted magnetically and electrically to the magnetic particles forming the magnetic particle layer 1501*a* of the second cleaning roll 152. In addition, an adjusting trimmer 158 for controlling the length of the clusters of conductive magnetic particle aligned linearly is connected to the cleaning unit 15 set forth in FIG. 2. The two recovery rolls 153 are placed respectively at positions in contact with the magnetic particle layers 1501*a* of respective cleaning rolls 151 and 152, and two scrapers 154 respectively at positions where the tips thereof are in contact with the surfaces of respective recovery rolls 153. Two recovery rolls 153 are rotating together with the recovery rolls. The recovery roll is not necessarily placed at a position in contact with the magnetic particle layer 1501*a* of the cleaning roll and may be placed at a position very close to the magnetic particle layer 1501*a*.

In the image-forming apparatus set forth in FIG. 1, a phenomenon called retransfer occurs occasionally wherein part of the toner image previously transferred onto the intermediate transfer belt 30 migrates onto the surface of the photoreceptor 11 whereon the next toner image is borne. The nonmagnetic toners brought back to the photoreceptor 11 by retransfer have charges opposite to the electrostatic charge-polarity of the nonmagnetic toners stored in the developing device 12, due to the electrostatic discharge during the transfer and retransfer. Accordingly, these toners are attracted by the magnetic particles forming the magnetic particle layer 1501*a* of the second cleaning roll 152. In contrast, the nonmagnetic toners remaining on the surface of the photoreceptor after the primary transfer have the same electrostatic charge polarity as that of the nonmagnetic toners stored in the developing device 12, and are attracted by the magnetic particles forming the magnetic particle layer 1501*a* of the first cleaning roll 151. Accordingly, in the cleaning unit 15, the two cleaning rolls 151 and 152 placed side by side in the rotative direction of the photoreceptor 11 improve the cleaning efficiency and at the same time, allow removal of the residual toners after transfer by the first cleaning roll 151 as well as the toners brought back onto the surface of the photoreceptor 11 by retransfer by the second cleaning roll 152. Further, in the cleaning unit 15 of this embodiment, discharge products and the like generated by electrostatic discharge by the electrostatic charging device 13 are removed by the cleaning rolls 151 and 152, and thus the lubricity of the surface of the photoreceptor 11 is of smaller importance when compared with the case where a blade is used for removal thereof. In addition, as the cleaning rolls 151 and 152 remove nonmagnetic toners present on the surface of the photoreceptor 11 by using a magnetic force, the fluctuation in the amount of residual toners, which depends on the formed image, does not affect the cleaning performance at all. The independence of the fluctuation in the amount of the residual toners, which leads to prevention of unbalanced wear of the photoreceptors in the image-forming apparatus equipped with plural photoreceptors, is particularly advantageous for image-forming apparatus employing the tandem method and thus having high-speed image forming ability. Further, the alternate current bias applied to each of the cleaning rolls 151 and 152 also improves the efficiency of cleaning.

Hereinafter, magnetic particles forming the magnetic particle layer 1501*a* will be described in detail. Magnetic carriers commonly used for two-component developers may be used as the magnetic particle. Ferromagnetic materials known in the art may be used, and typical examples thereof include magnetic metals such as iron, steel, nickel, and cobalt; and magnetic oxides such as ferrite and magnetite; and the like. The average particle diameter of the magnetic particle is commonly 10 to 300 μm and probably 20 to 150 μm. Particles having a diameter of 10 μm or less are easily transferred from the magnetic brush to the photoreceptor 11, while those having a diameter of 300 μm or more, although allow cleaning of toners, lead to decrease in the number of contact points between the magnetic brush and the photoreceptor 11, resulting in decrease in the efficiency in cleaning the discharge products derived from the so-called electrostatic charging device and thus increase in the frequency of so-called image deletion under a high-temperature and high-humidity environment. The magnetic particle may be used as it is, but it is possible to cover the particle with a resin-coating layer, for keeping the cleaning performance for an extended period of time and for prevention of scratching on the surface of the photoreceptor 11. It is also possible to disperse conductive fine powders in the matrix resin for adjustment of the electric resistance of the resin-coated layer. Examples of the matrix resins include polyethylene, polypropylene, polystyrene, polyacrylonitrile, polyvinyl acetate, polyvinylalcohol, polyvinylbutyral, polyvinyl chloride, polyvinylcarbazole, polyvinylether, polyvinylketone, vinyl chloride-vinyl acetate copolymers, styrene-acrylic acid copolymers, straight silicone resins having an organosiloxane bond or the modified derivatives thereof, fluorine resins, polyester, polyurethane, polycarbonate, phenol resins, amino resins, melamine resins, benzoguanamine resins, urea resins, amide resins, epoxy resins, and the like. However, the matrix resins are not limited thereto. Examples of conductive materials used for the conductive fine powder include metals such as gold, silver and copper, titanium oxide, zinc oxide, barium sulfate, aluminum borate, potassium titanate, tin oxide, carbon black, and the like, but are not limited thereto. The lower and upper limit values of the electric resistance of the magnetic particle may vary according to the processing speed and applied bias, but the lower limit value is probably adjusted in the range that allows prevention of the adhesion of magnetic particles onto the photoreceptor 11 as a result of charge injection into the magnetic brush, and the upper limit value in the range that allows prevention of the electric charge accumulation caused by the contact friction between magnetic particles and the toners adhering to the magnetic particles.

Next, two recovery rolls 153 set forth in FIG. 2 will be described in detail. These recovery rolls 153 absorb electrically, on the external surface thereof, the nonmagnetic toner adhering to the magnetic particle layer 1501*a* of the cleaning roll. The material for the recovery roll 153 include thermosetting resins such as phenol resins, urea resins, melamine resins, unsaturated polyesters, epoxy resins, polyimide resins, and the like. Among them, phenol resins are the most favorable materials, as they are excellent in dimensional accuracy, easier to mold, superior in the surface smoothness of the molded products, and additionally cheap. For the purpose of improving the stiffness and adjusting the electric resistance of the recovery rolls 153, one or more fillers, either organic or inorganic, or one or more pairs of organic and inorganic fillers may be contained in the recovery roll 153. The organic fillers include carbon black, carbon powder, graphite, magnetic powders, metal oxides such as zinc oxide, tin oxide, and titanium oxide; metal sulfides such as copper sulfide and zinc sulfide; so-called hard ferrites such as strontium, barium, and rare-earth metals; ferrites such as magnetite, copper, zinc, nickel and manganese or the derivatives thereof having the surface made more conductive; solid solutions of metal oxides obtained by burning at high temperature a metal compound selected from oxide, hydroxide, and carbonate or other metal compound, containing a different metal element such as copper, iron, manganese, nickel, zinc, cobalt, barium, aluminium, tin, lithium, magnesium, silicon, phosphorus, or the like; so-called complex metal oxides; and the like. Inorganic fillers include powders of metals such as tin, iron, copper, and aluminum; metal fiber, glass fiber, and the like.

If the electric resistance of the recovery roll 153 is less than $1\times10^5$ Ω, the recovery roll cannot electrically absorb the toners adhering to the cleaning rolls 151 and 152 due to charge injection. On the contrary, if the electric resistance of the recovery roll 153 is larger than $1\times10^{14}$ Ω, the recovery roll cannot electrically absorb the toners due to the so-called charge up, i.e., accumulation of electric charges on the recovery roll 153, and thus the electric resistance of the recovery roll 153 is probably in the range of $1\times^5$ to $1\times10^{14}$ Ω and more probably in the range of $1\times10^6$ to $1\times10^{12}$ Ω as determined when a voltage of 500V is applied. Further, for more efficient electrostatic migration and absorption of the toners, it is possible to apply a recovery bias of certain voltage between the magnetic particle layers 1501*a* of the cleaning rolls 151 and 152 and the recovery rolls 15, and thus direct-current power sources 159 having the same polarity as that of the direct-current bias applied to the cleaning rolls 151 and 152 which the recovery rolls are in contact with are connected respectively to the two recovery rolls 153 set forth in FIG. 2. Voltage difference between the magnetic particle layer 1501*a* and the recovery roll 153 maybe |100V| or more and possibly |200V| or more.

Next, the two scrapers 154 set forth in FIG. 2 will be described in detail. Each scraper 154 is fixed at one end and free at the other end, and the free end, which is in contact with the external surface of the recovery roll 153, scrapes off the nonmagnetic toners adsorbed on the contacting recovery roll 153. The scraper 154 may be a sheet metal of stainless or phosphor bronze from the viewpoints of durability and cost, and the thickness thereof is favorably about 0.02 to 2 mm.

As explained above, according to the invention, an image-forming apparatus having a cleaning mechanism that bestow favorable cleaning characteristics for an extended period of time, and an image-forming method including a cleaning step that allows favorable cleaning for an extended period of time can be provided.

EXAMPLES

Hereinafter, the present invention will be described in detail with reference to EXAMPLES, but it should be understood that the present invention is not limited to these EXAMPLES.

Example 1

Images are formed by using a same full-color tandem image-forming apparatus having the same configuration as that of the image-forming apparatus set forth in FIG. 1. More specifically, by using the blade cleaning system in the DocuColor2060 manufactured by Fuji Xerox Co., Ltd. as the cleaning unit having the same configuration as that set forth in FIG. 2, and by using a chart image having multiple regions different in concentration (toner quantity) in the processing direction, a test on forming images continuously on a hundred thousand papers was conducted under a high-temperature and high-humidity environment (30° C., 80% RH), followed by a test on forming images continuously on the same hundred thousand papers under a low-temperature and low-humidity environment (10° C., 20% RH).

Below is the brief summary of the cleaning unit used in EXAMPLE 1.

<First Cleaning Roll>

An 18ϕ SUS sleeve roll having a pentapole magnet inside was used as the sleeve roll.

The magnetic flux density in the region where the first cleaning roll became in contact with the photoreceptor was 0.13 $Wb/m^2$, while the magnetic flux density in the region where it became in contact with the recovery roll was 0.1 $Wb/m^2$.

A direct-current bias of +200 V was applied to the first cleaning roll.

The magnetic particles used had ferrite cores having an average particle diameter of 50 μm, outer surface thereof being coated with a methyl methacrylate resin wherein carbon black is dispersed.

<Recovery Roll>

A roll made from a material containing conductive carbon dispersed in a phenol resin was used as the recovery roll, which was brought into contact with the first cleaning roll. The recovery roll had an electric resistance of $1\times10^8$ Ω. The bending modulus thereof was 100 MPa, and the Rockwell hardness (M) 120. The recovery roll was arranged in such a manner that the roll invaded into the magnetic brush (magnetic particle layer) to a depth of 1.5 mm, and the peripheral velocity and the applied bias were set respectively at 70 mm/s and +600V.

<Second Cleaning Roll>

The second cleaning roll was set in the similar manner to the first cleaning roll, except that a direct-current bias of −400 V was applied.

<Recovery Roll>

The recovery roll in contact with the second cleaning roll was set in the similar manner to the cleaning roll in contact with the first cleaning roll, except that a direct-current bias of −800V was applied.

<Scraper>

Two SUS 304 scrapers having a thickness of 80 micron were used respectively. These scrapers were arranged respectively in such a manner that the scrapers invaded into the recovery roll to a depth of 1.3 mm. The length (free length) of each scraper from the fixed end to the free end was set at 8.0 mm.

During the image-forming test of printing a hundred thousand papers, there were observed no image deletion under the high-temperature and high-humidity condition, and no defects due to the fluctuation in the amount of residual toners depending on the formed image either under the high-temperature and high-humidity condition or the low-temperature and low-humidity condition.

Example 2

Although a photoreceptor having a surface layer containing a fluorine resin was not used in EXAMPLE 1, the photosensitive body for image-forming apparatus used in EXAMPLE 1 was replaced with a photoreceptor having a surface layer containing a fluorine resin in this EXAMPLE 2. Without changing of remaining image-forming apparatus, an image test of printing an image continuously on fifty thousand papers was conducted in the similar manner to EXAMPLE 1, but there were observed no defects due to the fluctuation in the amount of residual toners depending on the formed image either under a high-temperature and high-humidity condition or a low-temperature and low-humidity condition.

Preparation of the photoreceptor having a surface layer containing a fluorine resin A layer containing a fluorine resin was formed on the external wall of a photosensitive body by conducting the coating impregnation treatment described below.

First, a treatment solution A having the fluorine resins at the following composition as the essential components was coated on the external wall of a photosensitive body by dip coating.

The treatment solution A used had a viscosity of 200 Mpa·s.

| Treatment solution A | |
|---|---|
| Tetrafluoroethylene homopolymer | 12 parts. |
| Tetrafluoroethylene-hexafluoropropylene copolymer | 8 parts. |
| Paraffin-based medium-boiling solvent | 20 parts |
| Surfactant, thickener, and stabilizer | 15 parts |
| Water | 45 parts |

Subsequently, the laminate coated with the treatment solution A was dried in a thermostatic oven at 60° C. for 15 minutes, to give a photosensitive body for electrophotography.

Example 3

In this EXAMPLE 3, an image test of printing an image continuously on a million papers was conducted in the similar manner to EXAMPLE 1, except that the photosensitive body for image-forming apparatus used in EXAMPLE 1 was replaced with a photoreceptor having a surface layer containing a silicone resin. There were observed no defects due to the fluctuation in the amount of residual toners depending on the formed image ether under a high-temperature and high-humidity or a low-temperature and low-humidity condition.

Preparation of the photoreceptor having a surface layer containing a silicone resin Two parts of a compound (3) set forth in the following Formula (IV) and having substituents set forth in TABLE 1 (in the Table, iPr represents an isopropyl group), 2 parts of methyltrimethoxysilane, 0.5 part of tetramethoxysilane, 0.3 part of colloidal silica were dissolved in a mixture of 5 parts of isopropyl alcohol, 3 parts of tetrahydrofuran, and 0.3 part of distilled water; additionally 0.5 part of an ion-exchange resin (Amberlist 15E) was added thereto; and the resulting mixture was hydrolyzed by stirring at room temperature for 24 hours.

TABLE 1

Formula (IV)

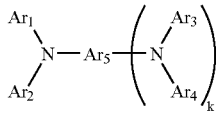

| compound | k | $Ar_1$ | $Ar_2$ | $Ar_3$ | $Ar_4$ | $Ar_5$ | X |
|---|---|---|---|---|---|---|---|
| (3) | 0 | 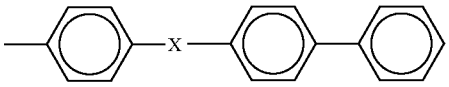 | | — | — | 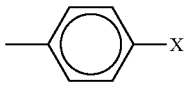 | $—(CH_2)_2—COO—(CH_2)_3—Si(OiPr)_3$ |

After removing the ion-exchange resin by filtration, 0.04 part of aluminium trisacetylacetonate and 0.1 part of 3,5-di-t-butyl-4-hydroxytoluene (BHT) were added to 2 parts of the liquid hydrolysate, to give a coating solution for surface protection layer. The coating solution was coated on the charge transport layer above by the ring immersion coating method. The coated photoreceptor was air-dried at room temperature for 30 minutes and then cured at 170° C. for 1 hour, to give a photoreceptor having a surface protection layer having a thickness of about 3 μm.

Comparative Example 1

An image-forming test similar to that in EXAMPLE 1 was conducted by using the blade cleaning system of the DocuColor 2060 manufactured by Fuji Xerox Co., Ltd. After the image-forming test, a chart image in half tone color over the entire surface was formed on a paper, and there was observed unevenness in concentration possibly due to the fluctuation in the amount of residual toners depending on the image used in the image-forming test. In addition, there were observed several lines generated in the area where the toner image is not formed and thus the color should be white (non-image portion). Further, observation of the blade after the image-forming test revealed that there were a large number of cracks in the blade at the positions corresponding to the non-image portion. In addition, measurement of the film thickness of the photoreceptor after the image-forming test indicated that the wear of-the film in the area where the toner image is formed (image portion) is greater than that of the area corresponding to the non-image portion by as much as 3 μm.

The results above confirmed that use of the conventional blade cleaning method in the full-color high-speed tandem systems, which are mainly operated in the mode of printing the same image continuously, leads to insufficient supply of lubricants (toner, external additive, and the like) to the blade that shortens the lifetime of the blade. However, application of the so-called magnetic brush cleaning system used in each EXAMPLE provides sufficient resistance to the stress of continuous formation of the same image and allows preservation of the excellent performance of the image forming system for an extended period of time.

In addition, the cleaning roll above may have a magnetic particle layer whereon multiple clusters of magnetic particles aligned linearly are sticking outward like brush bristles.

The magnetic particle layer present in the so-called magnetic brush shape increases the cleaning efficiency further.

In another embodiment of the image-forming apparatus according to the present invention, the toner image-forming unit may be equipped with recovery rolls having a magnetic particle layer of magnetic particles at the surface, which rotates in the state in contact with or in the neighborhood of the magnetic particle layer of the cleaning roll above and absorb nonmagnetic toners present on the surface of the magnetic particle layer; and scrapers in contact with the external surface of the recovery rolls for scraping off the nonmagnetic toners absorbed on the external surface thereof.

According to this embodiment, the toners can be recovered efficiently from the cleaning rolls.

In still another embodiment of the image-forming apparatus according to the present invention, the developing device develops the electrostatic latent image borne by the photoreceptor by using a magnetic carrier and a developer containing a nonmagnetic toner both in the same electrostatic charge polarity, and the plural cleaning rolls above each are equipped with a first cleaning roll to which a direct-current bias having the opposite electrostatic charge polarity to that of the nonmagnetic toner is applied and a second cleaning roll to which a direct-current bias having the same electrostatic charge polarity as that of the nonmagnetic toner.

Even when a phenomenon called retransfer occurs wherein part of the toner image previously transferred at the transfer site migrates onto the surface of the photosensitive latent image carrier whereon the next toner image is borne, the toner migrated by retransfer is cleaned by the second cleaning roll, and the residual toner after transfer at the transfer position is cleaned by the first cleaning roll in this favorable embodiment.

Further, in the image-forming apparatus according to the present invention, a direct-current bias and an alternate current bias are possibly applied both to the first and second cleaning rolls.

The additional application of an alternate current bias improves the cleaning efficiency further.

In yet another embodiment of the image-forming apparatus according to the present invention, it is possible that the photoreceptor rotates in a certain direction via a transfer position where the toner image is transferred to an image-receiving body and the toner image-forming unit further includes an antistatic device at a position between a cleaning roll located most upstream of the plural cleaning rolls and the transfer position for removal of the electric charge remaining on the surface of the photoreceptor.

Installation of the antistatic device allows leveling of the electric potential of the surface of the photoreceptor after transfer at the transfer position, and prevents the magnetic particles in the magnetic particle layer above from adhering to the surface of the photoreceptor.

In addition, in the image-forming apparatus according to the present invention, the plural cleaning rolls possibly has a magnetic particle layer of magnetic particles having a magnetic substance as the core and a resin layer covering the periphery thereof.

Presence of the resin layer around the magnetic particle allows preservation of the favorable cleaning performance for a further elongated period of time and ensures more reliable prevention of the damage of the photoreceptor.

Furthermore, in the image-forming apparatus according to the present invention, the plural cleaning rolls probably has a magnetic particle layer of magnetic particles having a magnetic substance as the core and a conductive particle-dispersed resin layer covering the periphery thereof.

Adjustment of the amount of the conductive particle dispersed allows adjustment of the resistance of the magnetic particle layer.

In yet another embodiment of the image-forming apparatus according to the present invention, the photoreceptor has a surface layer containing a fluorine resin on the surface bearing the electrostatic latent image, or the photoreceptor has a surface layer containing a silicone resin on the surface bearing the electrostatic latent image.

In the former embodiment, presence of a surface layer containing a fluorine resin improves release of the toner image from the photoreceptor at the transfer position and additionally the lubricity of the surface of the photoreceptor. In the latter embodiment, presence of a surface layer containing a silicone resin improves the wear resistance of the surface of the photoreceptor.

The entire disclosure of Japanese Patent Application 2003-176181 filed on Jun. 20, 2003, including specification, claims, drawings and abstract is incorporated herein by reference in its entirety.

What is claimed is:

1. An image-forming apparatus comprising a plurality of toner image-forming units that form toner images by developing electrostatic latent images by means of a developer containing a nonmagnetic toner and a magnetic carrier, that transfers and superimposes the toner images formed in respective toner image-forming units one by one to give a final superimposed image on a recording medium, fuses the superimposed toner image on the recording medium, and forms the fused toner image on the recording medium, wherein:

each of the toner image-forming units further comprises a photoreceptor, a developing device that supplies the developer above to the surface of the photoreceptor and develops an electrostatic latent image borne on the surface of the photoreceptor by using a magnetic carrier and a developer containing a nonmagnetic toner both in the same electrostatic charge polarity, a plurality of cleaning rolls each having a magnetic particle layer of magnetic particles at the surface, which are located in the state freely rotatable and in contact with or in the neighborhood of the surface of the photoreceptor and absorb nonmagnetic toners present on the surface of the photoreceptor on the magnetic particle layer thereof by rotation, the plurality of cleaning rolls each further comprise a first cleaning roll to which a direct-current bias having the opposite electrostatic charge polarity to that of the nonmagnetic toner is applied and a second cleaning roll to which a direct-current bias having the same electrostatic charge polarity as that of the nonmagnetic toner; and the photoreceptor is rotating at a peripheral velocity of approximately 200 mm/sec or more.

2. The image-forming apparatus according to claim 1, wherein the plurality of cleaning rolls each has a magnetic particle layer whereon a plurality of clusters of magnetic particles aligned linearly are sticking outward like brush bristles.

3. The image-forming apparatus according to claim 1, wherein each of the toner image-forming units further comprises recovery rolls each having a magnetic particle layer of magnetic particles at the surface, which rotate in the state in contact with or in the neighborhood of the magnetic particle layer of the cleaning roll above and absorb nonmagnetic toners present on the surface of the magnetic particle layer; and scrapers in contact with the external surface of the recovery rolls for scraping off the nonmagnetic toners absorbed on the external surface thereof.

4. The image-forming apparatus according to claim 1, wherein an alternate current bias is applied in addition to the direct-current bias both to the first cleaning roll and the second cleaning roll.

5. The image-forming apparatus according to claim 1, wherein the photoreceptor rotates in a certain direction via a transfer position where the toner image is transferred to an image-receiving body, and the toner image-forming unit further comprises an antistatic device at a position between a cleaning roll located utmost upstream of the plurality of cleaning rolls and the transfer position for removal of the electric charge remaining on the surface of the photoreceptor.

6. The image-forming apparatus according to claim 1, wherein the plurality of cleaning rolls each has a magnetic particle layer of magnetic particles having a magnetic substance as a core and a resin layer covering the periphery thereof.

7. The image-forming apparatus according to claim 1, wherein the plurality of cleaning rolls each has a magnetic particle layer of magnetic particles having a magnetic substance as the core and a conductive particle-dispersed resin layer covering the periphery thereof.

8. The image-forming apparatus according to claim 1, wherein the photoreceptor further has a surface layer containing a fluorine resin on the surface bearing the electrostatic latent image.

9. The image-forming apparatus according to claim 1, wherein the photoreceptor further has a surface layer containing a silicone resin on the surface bearing the electrostatic latent image.

10. An image-forming method that, in a system wherein a plurality of toner image-forming units for forming toner images by developing electrostatic latent images on the electrostatic latent image-bearing bodies by using a nonmagnetic toner and a developer containing a magnetic carrier are installed, comprises the steps of forming a toner image in each toner image-forming unit; transferring the toner image onto a recording medium; and fixing the transferred toner image on the recording medium; wherein the image-forming method further comprises the steps of:

developing the electrostatic latent image borne on the surface of the photoreceptor by supplying the developer to the surface of the photoreceptor which is rotating at a peripheral velocity of approximately 200 mm/sec or more and by using a magnetic carrier and a developer containing a nonmagnetic toner both in the same electrostatic charge polarity;

transferring the toner image obtained in the developing step above; and removing the nonmagnetic toners remaining on the surface of the photoreceptor (cleaning step); and the cleaning is conducted by a plurality of cleaning rolls each having a magnetic particle layer of magnetic particles at the surface, which are located in the state freely rotatable and in contact with or in the neighborhood of the surface of the photoreceptor, and the plurality of cleaning rolls each further comprise a first cleaning roll and a second cleaning roll, applying a direct-current bias having the opposite electrostatic charge polarity to that of the nonmagnetic toner to the first cleaning roll, and applying a direct-current bias having the same electrostatic charge polarity as that of the nonmagnetic toner to the second cleaning roll.

* * * * *